US012800229B2

(12) United States Patent
Rosales Huerta

(10) Patent No.: US 12,800,229 B2
(45) Date of Patent: Nov. 17, 2026

(54) PLATE HEAT EXCHANGER BASED ON THE HILBERT CURVE

(71) Applicant: UNIVERSIDAD TÉCNICA FEDERICO SANTA MARÍA, Valparaíso (CL)

(72) Inventor: Carlos Eduardo Rosales Huerta, Viña del Mar (CL)

(73) Assignee: UNIVERSIDAD TÉCNICA FEDERICO SANTA MARÍA, Valparaíso (CL)

( * ) Notice: Subject to any disclaimer, the term of this patent is extended or adjusted under 35 U.S.C. 154(b) by 20 days.

(21) Appl. No.: 18/719,184

(22) PCT Filed: Dec. 22, 2021

(86) PCT No.: PCT/CL2021/050122
§ 371 (c)(1),
(2) Date: Jun. 12, 2024

(87) PCT Pub. No.: WO2023/115230
PCT Pub. Date: Jun. 29, 2023

(65) Prior Publication Data

US 2025/0230983 A1 Jul. 17, 2025

(51) Int. Cl.
*F28D 1/03* (2006.01)
*F28F 3/02* (2006.01)
(Continued)

(52) U.S. Cl.
CPC ..... *F28D 1/03* (2013.01); *F28F 3/02* (2013.01); *F28F 3/08* (2013.01); *F28F 3/14* (2013.01); *F28F 13/06* (2013.01)

(58) Field of Classification Search
CPC ..... F28F 3/02; F28F 3/08; F28F 3/14; F28F 13/06; F28F 2210/02
(Continued)

(56) References Cited

U.S. PATENT DOCUMENTS 5,381,510 A * 1/1995 Ford ..... F24H 1/121 165/169
9,596,785 B2 * 3/2017 Brand ..... F28F 3/12
(Continued)

FOREIGN PATENT DOCUMENTS

CA 3052817 A1 * 3/2020 ..... H05K 7/20254
CN 107255425 A 10/2017
(Continued)

OTHER PUBLICATIONS

Scheithauer et al., "Potentials and Challenges of Additive Manufacturing Technologies for Heat Exchanger," IntechOpen, 2019, 23 pages.

*Primary Examiner* — Tho V Duong
(74) *Attorney, Agent, or Firm* — Procopio, Cory, Hargreaves & Savitch LLP

(57) ABSTRACT

The present invention relates to the field of mechanical engineering and heat transfer. In particular, it provides a plate heat exchanger based on a surface constructed from the Hilbert curve, characterized in that it comprises a three-dimensional structure of substantially quadrangular shape, formed by a plurality of stacked metal plates; a metal shell operatively covering said substantially quadrangular three-dimensional structure; a set of double channels for the circulation of a fluid 1 and of a fluid 2, which completely covers each of the metal plates forming said plurality of metal plates, following a Hilbert curve of arbitrary order; and a first main collector double duct for the fluid 1 that has passed through the channels in the plates, and a second main collector double duct for the fluid 2 that has passed through the complementary channels of the plates.

8 Claims, 6 Drawing Sheets

(51) Int. Cl.

| | |
|---|---|
| ***F28F 3/08*** | (2006.01) |
| ***F28F 3/14*** | (2006.01) |
| ***F28F 13/06*** | (2006.01) |

(58) Field of Classification Search
USPC ..... 165/167, 165
See application file for complete search history.

(56) References Cited

U.S. PATENT DOCUMENTS

| | | | | |
|---|---|---|---|---|
| 11,412,640 | B2 * | 8/2022 | Tomescu | H05K 7/20272 |
| 2020/0240721 | A1 * | 7/2020 | Kenney | F28D 1/035 |
| 2021/0095932 | A1 | 4/2021 | Poltorak | |

FOREIGN PATENT DOCUMENTS

| | | | | |
|---|---|---|---|---|
| CN | 109579575 | A | 4/2019 | |
| CN | 210892803 | U | 6/2020 | |
| CN | 112268471 | A | 1/2021 | |
| CN | 112629295 | A | 4/2021 | |
| CN | 112923765 | A | 6/2021 | |
| DE | 102019105133 | A1 * | 9/2020 | B60L 58/26 |
| DE | 212019000351 | U1 * | 3/2021 | H01M 10/625 |
| IN | 201841028799 | A | 2/2020 | |
| WO | WO-9721062 | A1 * | 6/1997 | F28D 9/0025 |

* cited by examiner

PLATE HEAT EXCHANGER BASED ON THE HILBERT CURVE

TECHNICAL FIELD OF INVENTION

The present invention relates to the field of mechanical engineering and heat transfer, specifically to the field of heat exchangers having sets of stationary ducts separated by plates or sheets for heat exchanging fluids, the fluids being in contact with different sides of a wall. In particular, it provides a plate heat exchanger based on a surface constructed from the Hilbert curve.

BACKGROUND OF THE INVENTION

Within the field of heat exchangers, an important part of indirect heat exchangers is the geometry used for the optimization of heat exchange between fluids at different temperatures, separated by an interface or wall.

Some geometrical configurations of indirect heat exchangers are known in the state of the art, but as industrial needs increase, it becomes necessary to create new, more efficient models.

Currently, there are plate heat exchangers that occupy a very important branch of indirect heat exchanger designs; one advantage of such plate heat exchangers is their potential to reach a higher ratio of heat transfer area per unit volume of the equipment. On the other hand, from a thermodynamic point of view, the best flow arrangement is the countercurrent heat exchanger.

An example of this type of exchanger is disclosed in document CN112923765, which describes a phase-change heat storage device, comprising an energy storage unit that is composed of a heat-retaining material, a turbulence unit, a fluid transportation channel, and a shell. This geometry contains a Hilbert curve-shaped metal framework and a phase-change filling material. In said heat-retaining material, the exterior of said shell is wrapped, wherein said metal framework in the Hilbert surface configuration is uniformly distributed within said shell, with a fluid passing transversely to the plane of the plates.

On the other hand, the document by Uwe Scheithauer (Potentials and Challenges of Additive Manufacturing Technologies for Heat Exchanger, Nov. 5, 2018) describes an article related to potential manufacturing technologies for heat exchangers. This paper suggests optimizing a heat exchanger by means of two objectives that define the scope of the design: on the one hand, the surface for heat exchanging should be maximal, and, on the other hand, the fluids flowing inside the heat exchanger should remain in it as long as possible. This is where fractals play a fundamental role in surface optimization. In particular, a surface generated from the Hilbert curve is one of the geometries that meets these characteristics.

However, the state-of-the-art background is silent with respect to applications of plate heat exchangers with fractal geometries having a fluid path optimization.

Consequently, there is a need to create a geometrical variety in heat exchanger plates containing channels with a geometrical shape such as the Hilbert surface, so that a fluid travels the curve described by said surface, thus maximizing the travel time and increasing the fluid path on said surface without increasing the volume of the equipment. At the same time, the layout can be configured so that the fluids flow countercurrent over the entire area of the heat transfer area, thus obtaining the maximum thermodynamic efficiency for a heat exchanger.

SUMMARY OF THE INVENTION

The present invention provides a plate heat exchanger having a heat transfer surface and fluid circulation channels based on the Hilbert curve, characterized in that it comprises: a three-dimensional structure of substantially quadrangular shape, formed by a plurality of stacked metal plates; a metal shell operatively covering said substantially quadrangular three-dimensional structure; a set of double channels for the circulation of a fluid 1 and a fluid 2, completely covering each of the metal plates forming said plurality of metal plates, following a Hilbert curve of arbitrary order; wherein said fluid 1 and fluid 2 enter, respectively, a first channel and a second channel of said set of double channels of each plate at opposite ends, circulating countercurrent along the entire area of the double channels; wherein said fluid 1 has a temperature $T_1$ and said fluid 2 has a temperature $T_2$, and wherein said temperatures $T_1$ and $T_2$ are different; a first main feed double duct supplying fluid 1 to said first channel of each of the plates, and a second main feed double duct supplying fluid 2 to said second channel of each of the plates; and a first main collector double duct for fluid 1 which has run through the channels of the plates, and a second main collector double duct for fluid 2 which has run through the complementary channels of the plates.

In a preferred embodiment, the plate heat exchanger is characterized in that the channels in each plate level completely cover its surface, permanently changing direction every one, two, or three hydraulic diameters of the channel, according to a Hilbert curve.

In another preferred embodiment, the plate heat exchanger is characterized in that the fluids 1 and 2 flowing through it flow countercurrent over the entire heat exchange area.

In another preferred embodiment, the plate heat exchanger is characterized in that it additionally comprises a pair of distribution headers operatively connected to each of the main feed double ducts and each of the main collector double ducts.

In a further preferred embodiment, the plate heat exchanger is characterized in that said pair of distribution headers direct the supplied fluids 1 and 2 towards their corresponding main feed double ducts, and collect the output fluids from each of their corresponding main collector double ducts.

In a preferred embodiment, the plate heat exchanger is characterized in that the supply of fluid 1 is made through multiple inlet openings, one per plate, which are arranged alternately towards the first channel or towards the second channel of each plate.

In another preferred embodiment, the plate heat exchanger is characterized in that, in accordance with the alternate supply of fluid 1 to the first channel or second channel of each plate, said fluid in this plate circulates countercurrent to the fluid 2 of the next plate of the three-dimensional structure formed by the plurality of stacked plates (12*a*, 12*b*, 12*c*).

In another preferred embodiment, the plate heat exchanger is characterized in that the supply of fluid 2 is made through multiple inlet openings, one per plate, which are arranged alternately towards the first channel or towards the second channel of each plate, following a sequence that is inverse to the sequence of the fluid 1 inputs.

In another preferred embodiment, the plate heat exchanger is characterized in that, in accordance with the alternate supply of fluid 2 to the first channel or second channel of each plate, said fluid in this plate circulates countercurrent to the fluid 1 of the next plate of the three-dimensional structure formed by the plurality of stacked plates (12*a*, 12*b*, 12*c*).

In a further preferred embodiment, the plate heat exchanger is characterized in that the collection of the processed fluids 1 and 2 is performed through multiple outlet openings, one per plate, through which the channels of the plates discharge said fluids towards their corresponding main collector double ducts.

DETAILED DESCRIPTION OF THE INVENTION

Figure 1:
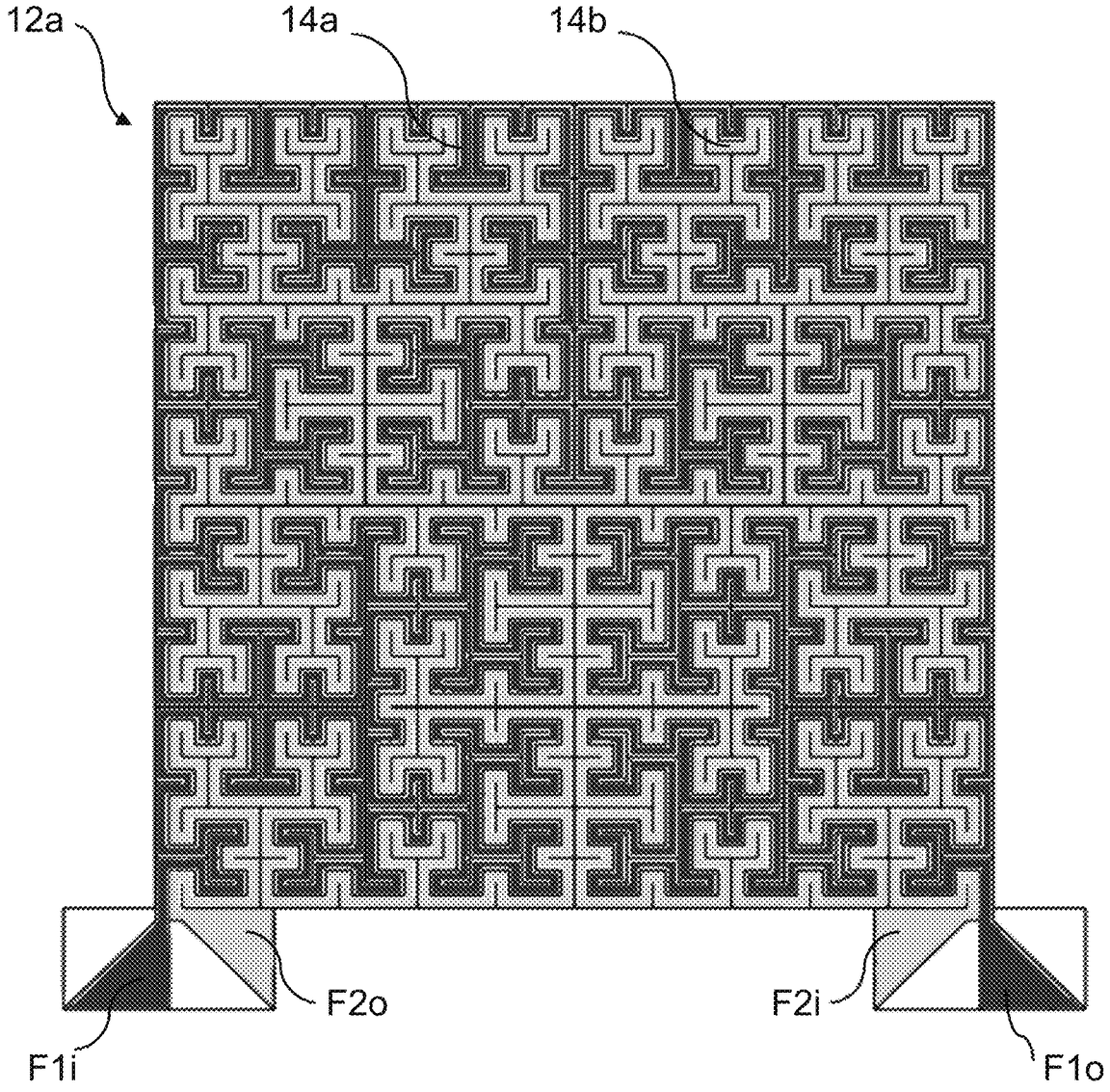
FIG. 1 illustrates a top cutaway view of a first embodiment of a plate (12*a*) of the heat exchanger (1) which is the subject of the present invention. It shows a first hot fluid 1 (F1) from left to right in a first channel (14*a*) and a cold fluid 2 (F2) from right to left in the second channel (14*b*). The illustrated geometry corresponds to an embodiment using a fifth generation Hilbert curve. Reference to the inlets and outlets of said fluids (F1, F2) is made with the objective of further clarifying the flow directions thereof.

Essentially, the plate heat exchanger (1) having a heat transfer surface and fluid circulation channels based on the Hilbert curve, which is the subject of the present invention, comprises: a three-dimensional structure of substantially quadrangular shape, formed by a plurality of stacked metal plates (12*a*, 12*b*, 12*c*); a metal shell (13) operatively covering said substantially quadrangular three-dimensional structure; a set of double channels (14*a*, 14*b*) for circulation of a fluid 1 (F1) and of a fluid 2 (F2), which completely covers each of the metal plates (12) forming said plurality of metal plates (12*a*, 12*b*, 12*c*), following a Hilbert curve of arbitrary order; wherein said fluid 1 (F1) and fluid 2 (F2) enter, respectively, a first channel (14*a*) and a second channel (14*b*) of said set of double channels (14*a*, 14*b*) of each plate (12) at opposite ends, circulating countercurrent along the entire area of the double channels (14*a*, 14*b*); wherein said fluid 1 (F1) has a temperature $T_1$ and said fluid 2 (F2) has a temperature $T_2$, and wherein said temperatures $T_1$ and $T_2$ are different; a first main feed double duct (15*a*) supplying fluid 1 (F1) to said first channel (14*a*) of each of the plates (12), and a second main feed double duct (15*b*) supplying fluid 2 (F2) to said second channel (14*b*) of each of the plates (12); and a first main collector double duct (16*a*) for fluid 1 (F1) which has run through the channels (14*a*, 14*b*) in the plates (12), and a second main collector double duct (16*b*) for fluid 2 (F2) which has run through the complementary channels (14) of the plates (12).

In the context of the present invention, and by way of general clarification throughout the description, the dimensions of the plate heat exchanger (1), as well as its component parts, in no way limit the scope of protection.

In the context of the present invention, and without limiting the scope thereof, a shell will be understood as an outer framework that provides consistency and protection to its contents. In a preferred embodiment, and without limiting the scope of protection, the metal shell (13) covering the three-dimensional structure is thermally insulated. In an even more preferred embodiment, the materials of said metal shell (13) that provide said thermal insulation also do not represent a limiting feature for the present invention.

The present invention, as schematically illustrated in FIGS. 1-6, consists of a plate heat exchanger (1) whose heat transfer surface is constructed from the Hilbert curve. Hereinafter, for simplicity and without limiting the scope of the present invention, the plate heat exchanger (1) based on this surface will be referred to as a heat exchanger with the Hilbert curve.

In the context of the present invention, for simplicity and without limiting the scope of the present invention, reference will be made to the first fluid as fluid 1 (F1) and to the second fluid as fluid 2 (F2); wherein said fluid 1 (F1) enters at a temperature $T_{1i}$ and exits at a temperature $T_{1o}$, and said fluid 2 (F2) enters at a temperature $T_{2i}$ and exits at a temperature $T_{2o}$. Indistinctly, the first fluid can be referred to as hot fluid and the second fluid as cold fluid, when $T_{1i}$ is higher than $T_{2i}$, or vice versa; the foregoing not limiting the scope of the present invention. Additionally, by way of general clarification, with respect to FIG. 1 and FIG. 2, fluid 1 (F1) and fluid 2 (F2) are illustrated with notations "i" and "o" as abbreviation of the words "in" and "out", referring to the inflow and outflow of said fluids and the direction in which they travel through the double channels (14*a*, 14*b*).

Figure 2:
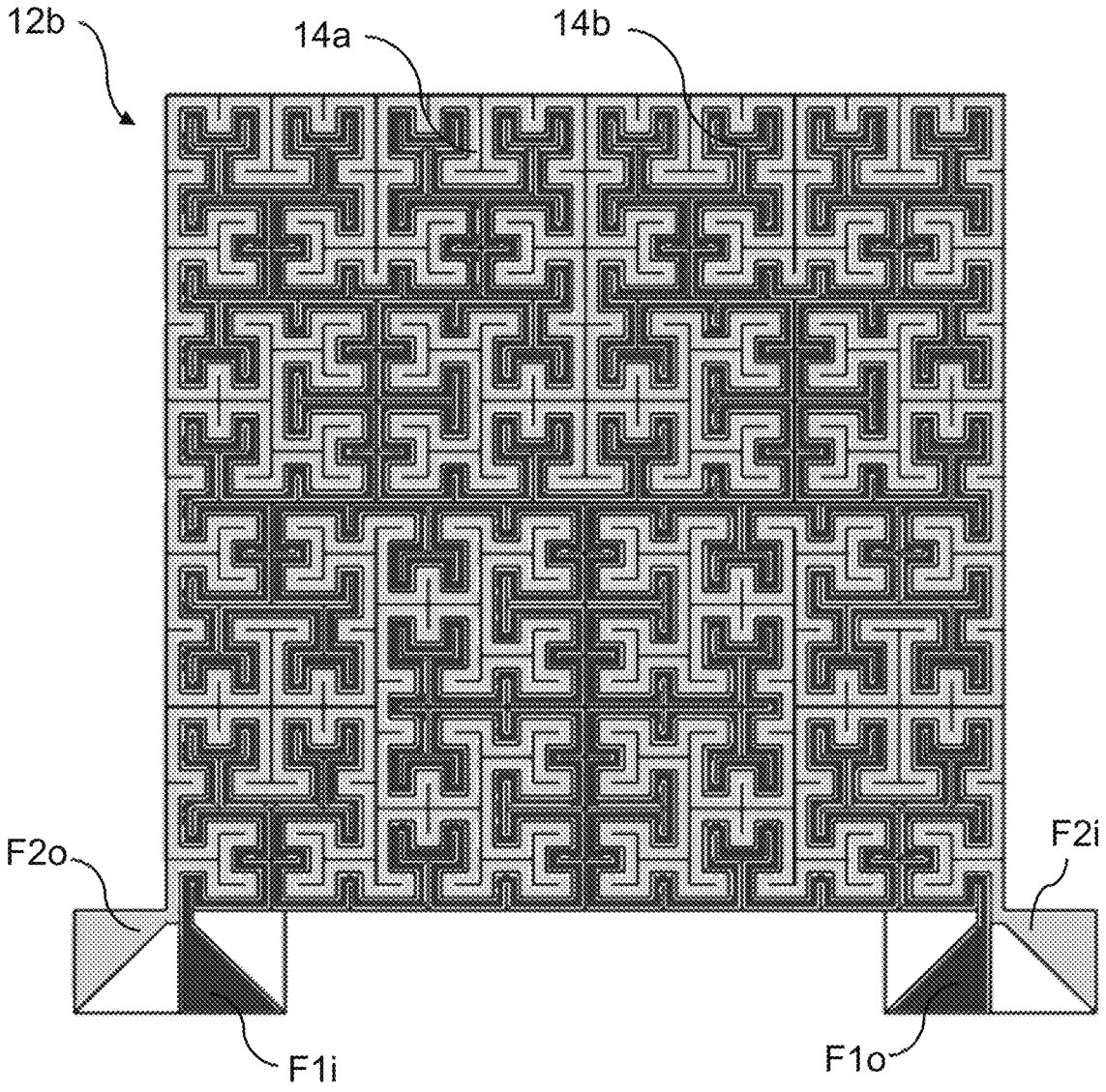
FIG. 2 illustrates a top cutaway view of a first embodiment of another plate (12*b*) of the heat exchanger (1) which is the subject of the present invention. Said plate being located above or below the plate (12*a*) illustrated in FIG. 1, wherein the hot fluid 1 (F1) now flows from left to right, in the second channel (14*b*), while the cold fluid 2 (F2) now flows from right to left in the first channel (14*a*). This plate (12*b*) is also based on a fifth generation Hilbert curve. Reference to the inlets and outlets of said fluids (F1, F2) is made with the objective of further clarifying the flow directions thereof.
Figure 3:
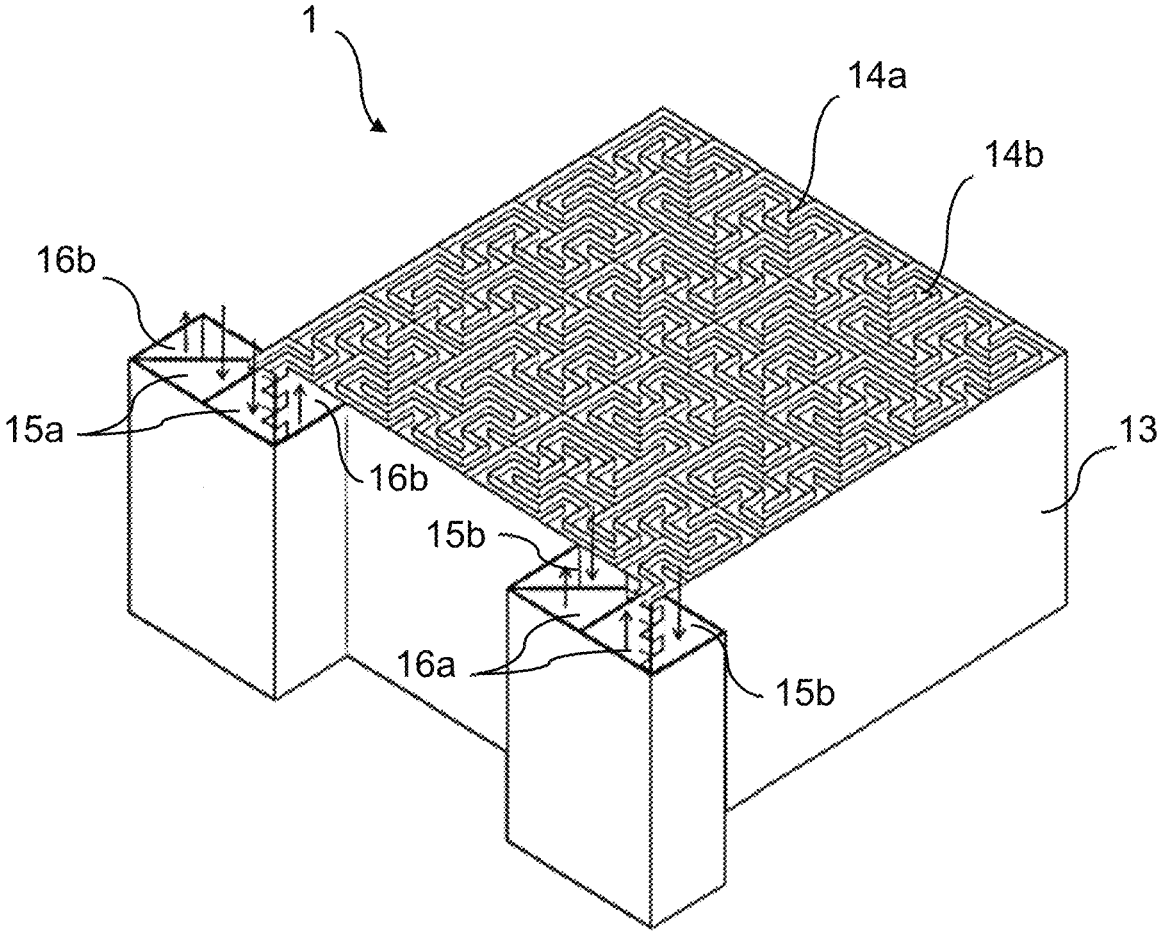
FIG. 3 illustrates an isometric cutaway view of a first embodiment of the heat exchanger (1) which is the subject of the present invention. On the left, the upward arrows indicate the flow direction of the cold fluid 2 (F2) which is collected in a discharge manifold after passing through the channels between plates. The downward arrows on the left side indicate the flow of the hot fluid 1 (F1) flowing along a distribution manifold towards its corresponding channels between plates. On the right side, upward arrows indicate the flow direction of the hot fluid 1 (F1) after passing through the channels between plates, and downward arrows indicate the flow direction of cold fluid 2 (F2) going into the channels between plates.
Figure 4:
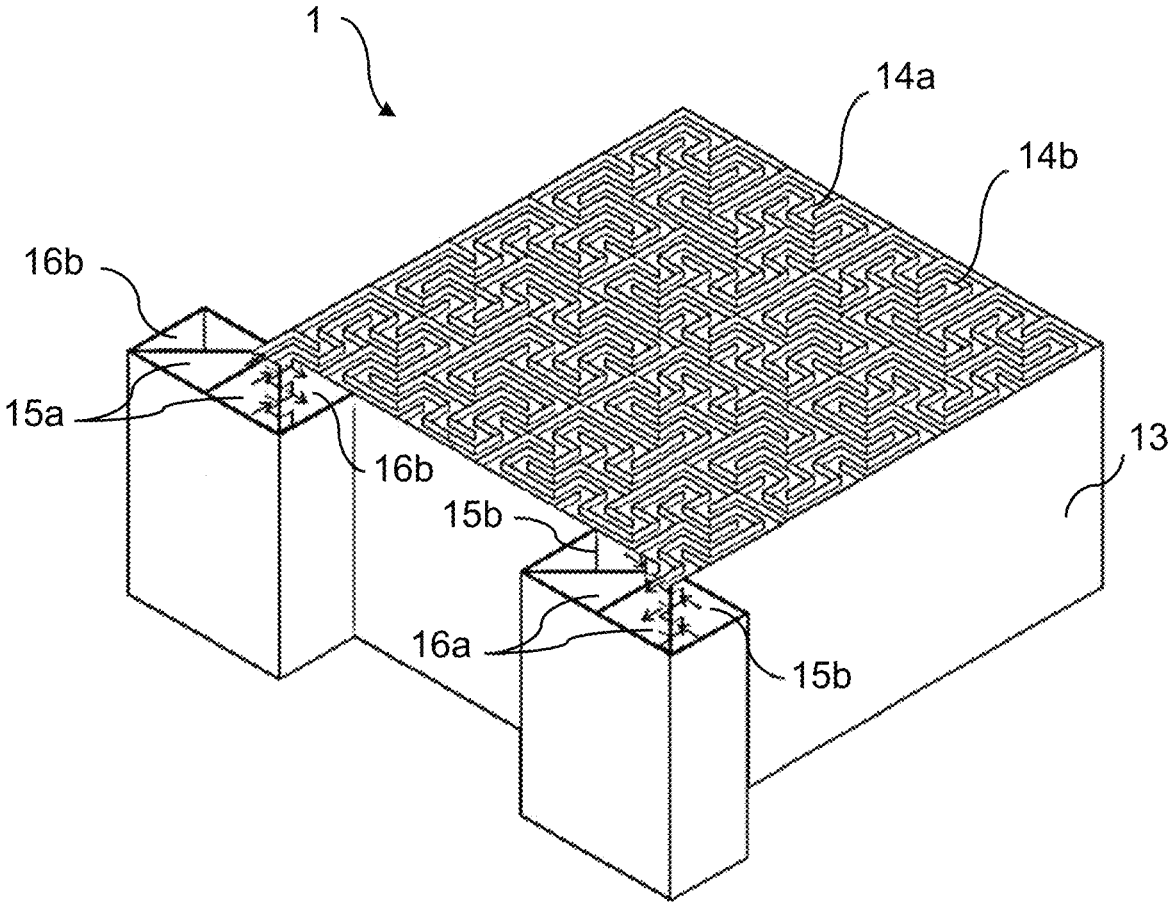
FIG. 4 illustrates an isometric cutaway view of a first embodiment of the heat exchanger (1) which is the subject of the present invention. On the left, arrows entering each plate represent the hot fluid 1 (F1) and on the right, arrows entering each plate represent the cold fluid 2 (F2). On both sides, the outgoing arrows represent the outflow of fluid 1 (F1) on the right, and fluid 2 (F2) on the left, both to their discharge collector manifolds.

In the present invention, the Hilbert curve is used as a generating line to trace the wall separating fluids 1 (F1) and 2 (F2) in the channels (14*a*, 14*b*) through which these fluids circulate over each plate (12). The Hilbert curve may be constructed by a multi-scale recursive procedure, which produces a self-similar geometry at different size scales. By varying the number of repetitions of the recursive procedure, curves of greater or lesser complexity are obtained. These Hilbert curves can be classified by the order they occupy in the generation sequence. FIGS. 1 and 2 show channels (14) generated with fifth generation Hilbert curves. The channels (14*a*, 14*b*) in FIGS. 3 and 4 are based on fourth generation Hilbert curves.

Fluids flow through channels (14*a*, 14*b*) where they permanently change direction by advancing one, two, or three hydraulic diameters along the channels (14), favoring the separation of the boundary layer at all these deviations and thereby increasing the overall convection coefficient.

The hydraulic diameter ($D_h$) is a term commonly used in hydraulics when handling fluids in non-circular channels and pipes. By means of this concept, it is possible to study the flow behavior in the same way as if it were a circular section pipe. The formula for calculating this is as follows:

$$D_h = \frac{4A}{P}$$

Where A is the cross-sectional area of the duct and P is the wet or damp perimeter.

In a preferred embodiment that is particularly advantageous, and without limiting the scope of protection, the order of the Hilbert curve allows to graduate how densely the channels (14) cover the surface of the plates (12). However, it does not limit the scope of the present invention, and different embodiments can be obtained by varying the order of generation of the Hilbert curve.

In a preferred embodiment, and without limiting the scope of protection, as schematically illustrated in FIG. 1, a plane of a plate (12) of quadrangular contour with a Hilbert curve (fifth generation) covering all plate quadrants is provided. The separating wall between the channels (14) of fluid 1 (F1) and fluid 2 (F2) in this plane is obtained by extruding the Hilbert curve in the third dimension perpendicular to the plane shown. The other sidewalls of the two channels (14*a*, 14*b*) in this plane are obtained through the complementary curve generated by tracing the straight lines joining the corners of the elementary cells used to generate the Hilbert curve (while the Hilbert curve passes through the centers of those cells). Said complementary curve is extruded at the same height to produce these other inner walls. The result is two parallel channels (14*a*, 14*b*) which, by curving themselves multiple times by 90° or 180° turns, move from an inlet to an outlet, completely covering the surface of the plate (12) along this path. The wall corresponding to the Hilbert curve is constructed of a material of high thermal conductivity, and heat transfer from fluid 1 (F1) to fluid 2 (F2) occurs through it. The materials of the walls do not limit the scope of the present invention. In a preferred embodiment, and without limiting the scope of protection, the walls corresponding to the complementary curve are made of a thermally insulating material to minimize heat transfer from a fluid to itself.

Thus, in this preferred embodiment, without limiting the scope of the present invention, the pattern produced by the Hilbert curve and its complementary curve separates the entire quadrangular contour into these two channels (14*a*, 14*b*). Said channels (14*a*, 14*b*) have two openings each, at the left and right ends of the quadrangular contour. Through these openings, fluids 1 (F1) and 2 (F2) enter their corresponding channels (14*a*, 14*b*), and exit them after passing through the entire channel (14). The inflow of the fluids occurs at opposite ends, so that when passing through the channels (14*a*, 14*b*) they always circulate countercurrent.

In a further preferred embodiment, and without limiting the scope of protection, the upper and lower walls of these channels (14*a*, 14*b*) are obtained by placing plates (12) above and below having the same geometrical pattern of channels (14). Thereby, each of the two channels (14*a*, 14*b*) shown in FIG. 1 has a channel (14) equal to the one above it, separated by a plate (12). Similarly, each of these two channels (14*a*, 14*b*) has a channel (14) equal to the one below it, separated by another plate (12). These plates (12) are also made of a material of high thermal conductivity. The fluid flowing through the channels (14*a*, 14*b*) above and below the channel with fluid 1 (F1) is fluid 2 (F2), so that fluid 1 (F1) in one plane transfers heat to fluid 2 (F2) not only through the curved Hilbert wall, but also through its upper and lower walls. Similarly, the fluid flowing through the channels (14*a*, 14*b*) above and below the channel with fluid 2 (F2) is fluid 1 (F1), which allows fluid 2 (F2) in a plane to receive heat from fluid 1 (F1) not only through the curved Hilbert wall, but also from the upper wall and the lower wall.

To obtain this flow configuration, the inlets and outlets of the upper and lower levels are alternated with respect to the inlets and outlets of the level shown in FIG. 1. Furthermore, FIG. 2 schematically shows a horizontal section of a plane for the plates (12) of the upper level with respect to the plane of FIG. 1. On the other hand, in FIG. 2 the inlet of fluid 1 (F1*i*) is now on the far left, but on the alternate side of the feed double duct (15), and the channel (14*b*) carrying fluid 1 (F1) runs above the channel (14*b*) carrying fluid 2 (F2) of the plane in FIG. 1. In turn, the inlet of fluid 2 (F2*i*) in the plane of FIG. 2 is on the far right, and the channel (14*a*) carrying fluid 2 (F2) runs above the channel (14*a*) of fluid 1 (F1) in FIG. 1. For the level below the plane of FIG. 1 the flow pattern would be the same as that indicated in FIG. 2.

The described plurality of stacked plates (12*a*, 12*b*, 12*c*) generates a three-dimensional arrangement of heat transfer surfaces, although the flow channels are curved multiple times, so that the heat transfer in the heat exchanger (1) is three-dimensional; thereby obtaining a flow arrangement that produces maximum thermodynamic efficiency while maintaining a compact shape. FIG. 3 shows an isometric view of a horizontal section of the heat exchanger (1) at some arbitrary level, wherein the channels (14*a*, 14*b*) of fluid 1 (F1) and fluid 2 (F2) are exposed at said level. In the case of FIG. 3, the illustrated embodiment corresponds to a fourth generation Hilbert curve. Fluids 1 (F1) and 2 (F2) are supplied to the Hilbert channels located between the plates (12) from main feed ducts (15*a*, 15*b*) located at the left and right ends. These main feed double ducts (15*a*, 15*b*) have multiple openings, which correspond to the inlets through which the fluids flow into their corresponding channels (14*a*, 14*b*); hereinafter, and for simplicity of description, they will be simply designated as feed manifolds. Likewise, next to these ducts, main collector double ducts (16*a*, 16*b*) are located, into which the Hilbert channels of each level discharge; hereinafter, and for simplicity of description, these outlet collector double ducts (16*a*, 16*b*) will be designated as collector manifolds.

FIG. 4 shows some of the inlets and outlets of fluids 1 (F1) and 2 (F2) to or from the Hilbert channels at some levels. The alternation between the inflow and outflow points, for each level, produces the flow pattern mentioned above. Thus, the channel (14*a*) of fluid 1 (F1), at a certain level, is surrounded by channels carrying fluid 2 (F2) circulating countercurrent, to which it transfers heat: a channel (14*b*) from the side and channels (14*a*) from above and below.

Similarly, the channels (14*b*) of fluid 2 (F2) at each level are surrounded by channels carrying fluid 1 (F1) circulating countercurrent, from which they receive heat: a channel (14*a*) from the side and channels (14*b*) from above and below. To alternate the side (left or right) through which a fluid enters, there are two feed manifolds (15*a*, 15*b*) on each side for each fluid. The openings connecting the Hilbert channels to these feed manifolds (15*a*, 15*b*) vary alternately from one level to the next, as shown in FIGS. 1, 2, and 4. This reverses the flow directions between the channels of one level and those of the next, and at the same time the position of the channel (14) through which the fluids will flow.

Figure 5:
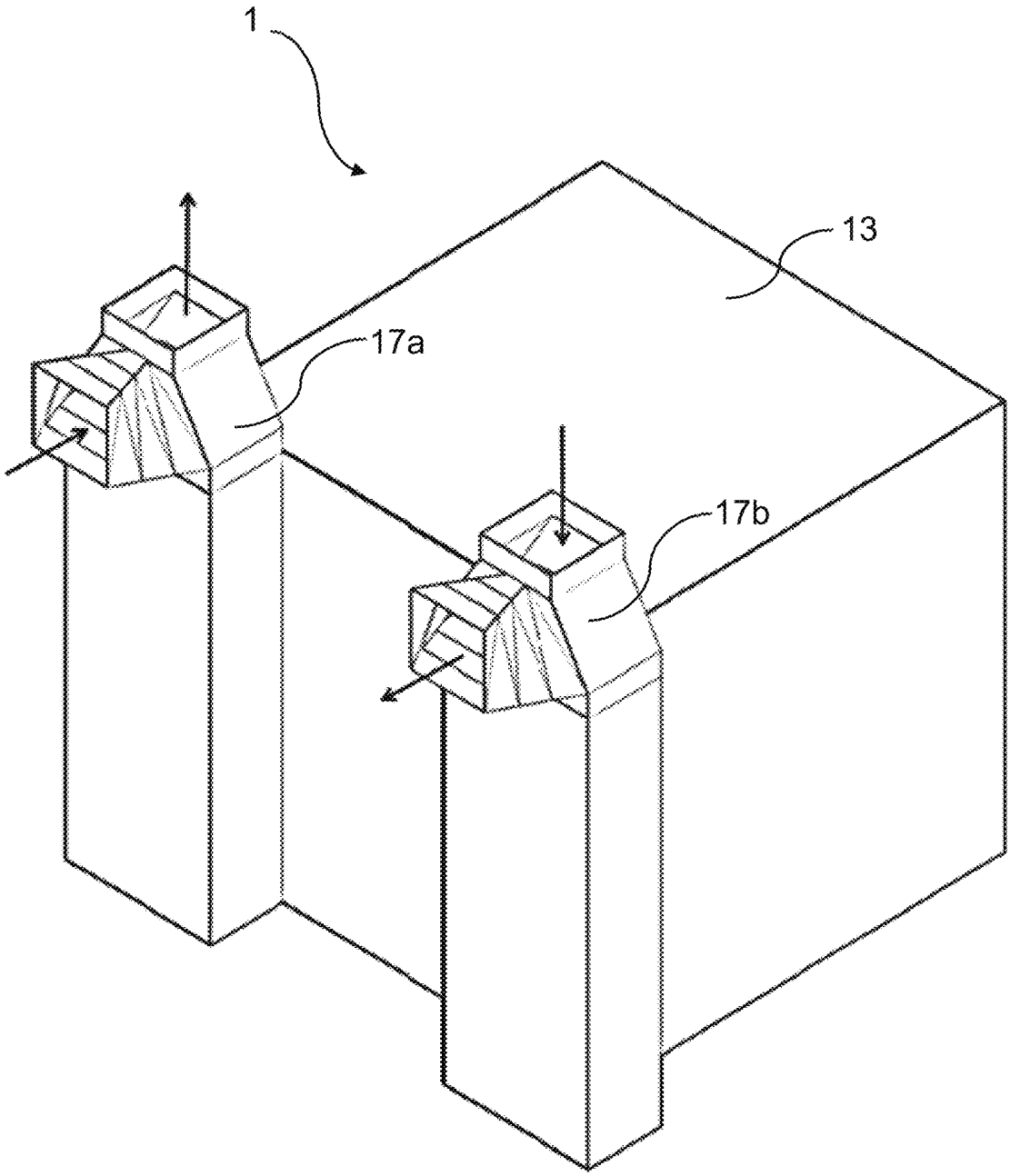
FIG. 5 illustrates an external isometric view of the heat exchanger (1) which is the subject of the present invention. Wherein the inflow of fluids 1 (F1) and 2 (F2) to the heat exchanger is observed, as well as their corresponding outflows at the points indicated; these correspond to the connection points of the heat exchanger (1) to the ducts or feed tubes (15*a*, 15*b*) of the fluids to be processed.
Figure 6:
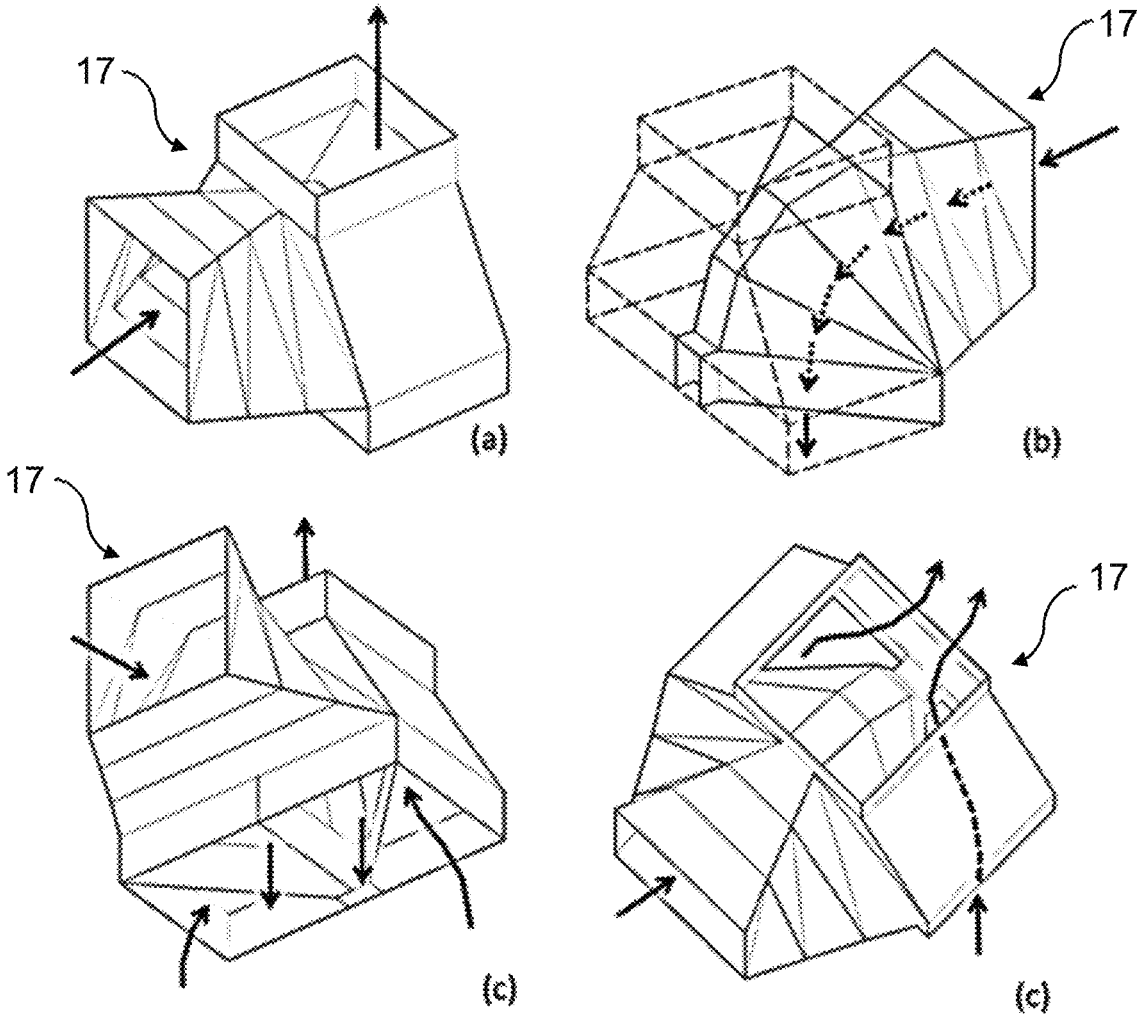
FIG. 6 illustrates four different views of one of the fluid distribution headers (17) of the heat exchanger (1) which is the subject of the present invention. (a) isometric view, as shown for the header on the left side of the heat exchanger in FIG. 5; (b) internal view of the duct for fluid 1; (c) view from below showing fluid 1 (F1) flowing in the central ducts and fluid 2 (F2) in the side ducts; (d) view from above showing fluid 2 (F2) flowing around the hood that feeds fluid 1 (F1) to the main distribution collector.

This plurality of stacked plates (12*a*, 12*b*, 12*c*), with Hilbert channels, to which fluids 1 (F1) and 2 (F2) are supplied through multiple feed manifolds (15*a*, 15*b*), and from which they receive the fluids in collector manifolds (16*a*, 16*b*) after passing through the channels (14*a*, 14*b*), produces a tower type structure. Hereinafter, for simplicity and without limiting the scope of the present invention, a tower type structure with a rectangular base will be referred to as a tower type structure. The height of this tower is configurable in its construction, and depends on the number of plates (12) that it is decided to put on the plurality of stacked plates (12*a*, 12*b*, 12*c*). Thus, the ratio of height to lateral dimensions of the heat exchanger (1) can be adjusted depending on the available space. FIG. 5 schematically shows the complete heat exchanger (1), up to the top level of the tower type structure. The outer surfaces of the heat exchanger (1) form a metal shell (13) within which the core of the heat exchanger (1) is located, with its plurality of stacked plates (12*a*, 12*b*, 12*c*), wherein each comprises Hilbert channels. This metal shell (13) is made of a thermally insulating material.

In a preferred embodiment, and without limiting the scope of the present invention, at the upper ends of the feed manifolds (15*a*, 15*b*) and collector manifolds (16*a*, 16*b*) there are distribution headers (17*a*, 17*b*) which allow to operatively connect the heat exchanger (1) to ducts or pipes for conveying the fluids 1 and 2 to and from the heat exchanger (1), as schematically illustrated in FIG. 5. Said distribution headers (17*a*, 17*b*) channel the supplied fluids to the two feed manifolds (15*a*, 15*b*) on each side. At the same time, said distribution headers (17*a*, 17*b*) collect the processed fluid flows exiting through the two collector manifolds (16*a*, 16*b*) on each side. In another preferred embodiment, and without limiting the scope of the present invention, said distribution headers (17*a*, 17*b*) are internally divided into sections for each fluid, as shown schematically in FIG. 6. The fluid 1 (F1) which is supplied to the heat exchanger (1) passes through a hood, internal to the header (17), where it is diverted and directed towards the two feed manifolds (15*a*, 15*b*), on the side where the header (17) is installed. Outside this hood, and inside the chamber containing it, flows the fluid 2 (F2) coming from the collector manifolds (16*a*, 16*b*) on that side. The two flows coming from the collector manifolds (16*a*, 16*b*) meet in this chamber and are directed towards the outlet of the heat exchanger (1). The configuration illustrated in FIG. 6 corresponds to the header (17) located at the upper left end of the heat exchanger (1) shown in FIG. 5. For the header (17) located at the upper right end, the configuration is the same, but the flow directions are reversed.

The invention claimed is:

1. A plate heat exchanger (1) having a heat transfer surface and fluid circulation channels based on Hilbert curve, comprising:

a three-dimensional structure of substantially quadrangular shape, formed by a plurality of stacked metal plates (12*a*, 12*b*, 12*c*);

a metal shell (13) operatively covering said substantially quadrangular three-dimensional structure;

a set of double channels (14*a*, 14*b*) for circulation of a fluid 1 (F1) and of a fluid 2 (F2), which completely covers each metal plate of the plurality of stacked metal plates (12*a*, 12*b*, 12*c*), following a Hilbert curve of arbitrary order;

wherein said fluid 1 (F1) and fluid 2 (F2) enter, respectively, a first channel (14*a*) and a second channel (14*b*) of said set of double channels (14*a*, 14*b*) of each plate of the plurality of stacked metal plates (12*a*, 12*b*, 12*c*) at opposite ends, circulating countercurrent along an entire area of the double channels (14*a*, 14*b*);

wherein said fluid 1 (F1) has a temperature $T_1$ and said fluid 2 (F2) has a temperature $T_2$, and wherein said temperatures $T_1$ and $T_2$ are different;

a first main feed double duct (15*a*) that supplies fluid 1 (F1) to said first channel (14*a*) of each plate of the plurality of stacked metal plates (12*a*, 12*b*, 12*c*), and a second main feed double duct (15*b*), that supplies fluid 2 (F2) to said second channel (14*b*) of each plate of the plurality of stacked metal plates (12*a*, 12*b*, 12*d*);

a first main collector double duct (16*a*) of the fluid 1 (F1), wherein the fluid 1 (F1) has run through the channels (14*a*, 14*b*) in the plurality of stacked metal plates (12*a*, 12*b*, 12*c*), and a second main collector double duct (16*b*) of the fluid 2 (F2), wherein the fluid 2 (F2) has run through channels (14*a*, 14*b*) on each of the plurality of stacked metal plates (12*a*, 12*b*, 12*c*); and a pair of distribution headers (17*a*, 17*b*) operatively connected to each of the main feed double ducts (15*a*, 15*b*) and each of the main collector double ducts (16*a*, 16*b*), wherein the pair of distribution headers (17*a*, 17*b*) direct the fluids 1 (F1) and 2 (F2) towards their corresponding main feed double ducts (15*a*, 15*b*), and collect the fluids (F1, F2) from each of their corresponding main collector double ducts (16*a*, 16*b*).

2. The plate heat exchanger (1) according to claim 1, wherein the channels (14*a*, 14*b*) in each plate of the plurality of stacked metal plates (12*a*, 12*b*, 12*c*) completely cover its surface, permanently changing direction, according to a Hilbert curve, wherein the direction changing occurs every one, two, or three hydraulic diameters of the channel.

3. The plate heat exchanger (1) according to claim 1, wherein the fluids 1 (F1) and 2 (F2) flowing through the plate heat exchanger (1) flow countercurrent throughout the heat transfer surface.

4. The plate heat exchanger (1) according to claim 1, wherein the fluid 1 (F1) flows through multiple inlet openings, one per plate of the plurality of stacked metal plates (12*a*, 12*b*, 12*c*), which are arranged alternately towards the first channel (14*a*) or towards the second channel (14*b*) of each plate of the plurality of stacked metal plates (12*a*, 12*b*, 12*c*).

5. The plate heat exchanger (1) according to claim 4, wherein according to an alternating supply of the fluid 1 (F1) to the first channel (14*a*) or second channel (14*b*) of each plate of the plurality of stacked metal plates (12*a*, 12*b*, 12*c*), the fluid (F1) in one of the of the plurality of stacked metal plates (12*a*, 12*b*, 12*c*) circulates countercurrent to the fluid 2 (F2) of a next plate of the plurality of stacked metal plates (12*a*, 12*b*, 12*c*).

6. The plate heat exchanger (1) according to claim 4, wherein the fluid 2 (F2) flows through multiple inlet openings, one per plate, which are arranged alternately towards the first channel (14*a*) or towards the second channel (14*b*) of each plate of the plurality of stacked metal plates (12*a*, 12*b*, 12*c*).

7. The plate heat exchanger (1) according to claim 6, wherein according to an alternating supply of the fluid 2 (F2) to the first channel (14*a*) or second channel (14*b*) of each plate of the plurality of stacked metal plates (12*a*, 12*b*, 12*c*), the fluid (F2) in one plate of the plurality of stacked metal plates (12*a*, 12*b*, 12*c*) circulates countercurrent to the fluid 1 (F1) of a next plate of the plurality of stacked metal plates (12*a*, 12*b*, 12*c*).

8. The plate heat exchanger (1) according to claim 1, wherein the fluids 1 (F1) and 2 (F2) flow through multiple outlet openings, one per plate, through which the channels (14*a*, 14*b*) of the plurality of stacked metal plates (12*a*, 12*b*, 12*c*) discharge said fluids (F1, F2) towards their corresponding main collector double ducts (16*a*, 16*b*).

* * * * *